United States Patent [19]

Lalieu

[11] 4,259,850

[45] Apr. 7, 1981

[54] EARRING WITH SELECTABLE DECORATIVE ELEMENT

[76] Inventor: Leon M. Lalieu, Overlook Rd., Lake Paradise, Woodburn, N.Y. 12788

[21] Appl. No.: 12,371

[22] Filed: Feb. 15, 1979

[51] Int. Cl.[3] ..... A44C 7/00

[52] U.S. Cl. ..... 63/13; 128/330

[58] Field of Search ..... 63/12, 13, 1 R, 2, 29; D11/40; 128/330; 119/96, 156; D30/43

[56] References Cited

U.S. PATENT DOCUMENTS

| | | | |
|---|---|---|---|
| 718,708 | 1/1903 | Geiger et al. | 63/13 |
| 758,848 | 5/1904 | Pejchar | 63/12 |
| 3,533,247 | 10/1970 | Douglas | 63/13 X |

*Primary Examiner*—F. Barry Shay
*Attorney, Agent, or Firm*—Anthony H. Handal

[57] ABSTRACT

An earring which comprises a retainer (14) and a securing pin (20) linked together by a chain (12) is disclosed. The securing pin mates with a closure (24) which may be secured to it.

When it is desired to wear the inventive earring, the wearer passes the pin (20) through a bead (28) or other decorative object, bringing the bead (28) into abutting relationship with the retainer (14). The pin (20) is then passed through a hole in the user's ear lobe (32) and attached to the closure (24). The chain (12) may then be pulled through the ear any desired amount in either direction to achieve the desired visual effect.

3 Claims, 8 Drawing Figures

EARRING WITH SELECTABLE DECORATIVE ELEMENT

TECHNICAL FIELD

The invention relates to earrings of the type which includes means for accommodating and wearing a selected decorative object or objects.

BACKGROUND ART

Recent years have witnessed an increasing awareness of the importance of proper dress and attire. The result is that people are now dressing better than they have in the past, and making the proper impression requires and even more critical selection of clothes and accessories with sensitivity to the subtle effect of such things as color, the formality of the apparel and so forth.

In the case of clothing, this presents a relatively minor problem, inasmuch as garments have a relatively short lifespan and are relatively inexpensive to purchase. Thus, a person may own a wardrobe including casual clothes, formal clothes, working clothes, and sports outfits.

In contrast, accessories in general, and jewelry in particular are very expensive but have a long lifespan. Jewelry is thus particularly sensitive to changes in style or any need for a diverse collection of pieces. Being properly dressed requires that the jewelry a person wears be as tailored and diverse as the other parts of one's wardrobe. Oftentimes, the expense associated with such a diverse collection of jewelry is prohibitive to the individual.

One part of the solution to this problem which appears in the prior art is an item of jewelry which has removable and selectable decorative elements. For example, earrings have been designed which comprise a conventional clip and a base which is adapted to receive a decorative plastic object which has structure which engages the earring. This earring is advantageous inasmuch as it allows the wearer to select an earring design whose color goes along with the color of the outfit that one is wearing. It is also advantageous because an earring with a plurality of substitutable elements is far less expensive than a plurality of individual earrings.

Nevertheless, this sort of multi-element earring does suffer from a number of disadvantages. These disadvantages include a number of problems associated with the structure of conventional earrings as well as limitations in the adaptability of such multi-element earrings. For example, conventional earrings for unpierced ears must apply a relatively high level of pressure to the earlobe in order to be secured to the ear. This causes the wearer a degree of discomfort and necessitates that the earrings cannot be worn for extended periods of time. Nevertheless, such earrings still have a tendency to fall off the ear of a wearer, oftentimes without notice.

Conventional earrings which are made for use by individuals who have pierced ears suffer from similar problems. The elements securing the earrings to the earlobe are likely to apply pressure during use, and to slip or snap off after extended periods of use. Still yet another disadvantage is the fact that if, for some reason, excess pressure is applied to the earring, the earring is likely to cause injury to the ear of the user.

In addition, earrings for use on pierced ears add the complication of a possibility of infection. For example, after an ear has been freshly pierced, the individual must wear an earring, in order to stop the ear hole from healing closed. Unfortunately, the presence of the earring pin prevents an applied antiseptic from going into the newly pierced ear. It is also believed that even after the ear has been successfully pierced and properly healed, the fact that no air is allowed into the hole by the pin encourages infection within the ear hole.

DISCLOSURE OF INVENTION

The invention as claimed is intended to provide a remedy. It solves the problem of how to provide an earring which is comfortable, secure, less likely to infect or injure a user and easy to use. The inventive earring also allows a wearer to select the color, size, and shape of the earring from a wide selection of possibilities. At the same time, the construction of the earring is simple, economical and dependable.

The advantages offered by the invention subsist mainly in the securing means. In particular, the securing means comprises a quality engagement structure which also doubles as means for holding one or a number of the composite elements which make up the earring. At the same time the device may be made in such a manner that it will provide a positive engagement with the ear while it may also be adapted to break away in the event that an unusual stress or strain is applied to the earring.

BRIEF DESCRIPTION OF DRAWINGS

Several ways of carrying out the invention are described in detail below with the reference to the drawings which illustrate only several specific embodiments, in which.

BEST MODE FOR CARRYING OUT THE INVENTION

Figure 1:
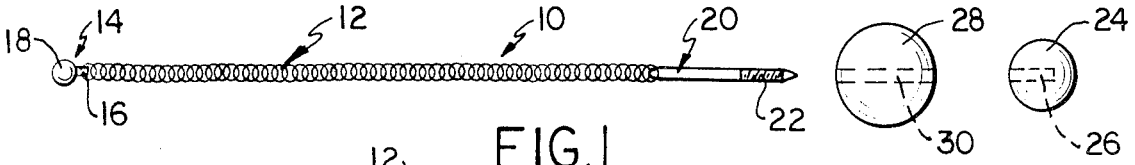
FIG. 1 is an exploded plan view of an earring constructed in accordance with the present invention.
Figure 2:
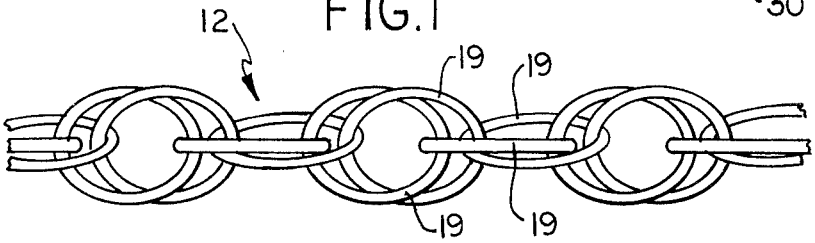
FIG. 2 is a schematic illustration of a chain used in the earring illustrated in FIG. 1.

Referring first to FIG. 1, an earring constructed in accordance with the invention is illustrated in exploded perspective. The earring 10 comprises a double-woven chain 12 which is secured at one end to a retainer 14. Retainer 14 comprises a short pin portion 16 and a head 18. In accordance with the preferred embodiment, retainer 14 is made of metal. Because of the intended use, it may be desirable to make the retainer of gold or other similar material. Likewise, chain 12 should be made of gold or similar non-reactive material in order to lessen the possibility of infection. It may also be desirable to make the chain weaker than the flesh of the earlobe which surrounds it so that it will break before it injures the ear when stress is applied. Chain 12 may be secured to retainer 14 by soldering with a precious metal. A typical chain for use with the present invention is illustrated schematically in FIG. 2. It comprises a plurality of interlocking links 19 which may be made of gold or other precious metals. The other end of chain 12 is soldered to a pin 20 which is long enough to pass through a pierced ear. The end of pin 20 opposite the point where it is secured to chain 12 is provided with threads 22.

The inventive earring is provided with a closure element 24, which may be in the form of a ball or any other desired shape. Closure 24 is provided with a tapped hole 26 which has threads which mate with threads 22. When it is desired to close the inventive earring, the closure 24 is positioned over pin 20 with threads 22 in engagement with the threads in tapped hole 26. Closure 24 is then rotated until pin 20 is securely screwed into the closure.

When it is desired to use the inventive earring, a decorative bead or other object 28 is taken and the pin 20 is passed through the object. Naturally, pin 20 must be long enough to allow it to be passed through passage 30 in object 28. This allows passage 30 to be made very narrow and only wide enough for it to pass pin 20 and chain 12.

In accordance with the preferred embodiment, pin 20 and chain 12 have substantially the same thickness. It is also desirable that chain 12 be of the double-woven type, inasmuch as such a chain provides surfaces which extend in more directions than a simple link chain in which the links lie in only two planes. Thus, suitable chains may include conventional chains which are substantially solid i.e. chains whose outside surfaces define a volume which is mostly filled with the metal of which the chain is made. Naturally, the more "solid" a chain is the less freedom and flexibility of movement it has. However, because of the use to which the chain is put, acceptable results can be obtained with relatively inflexible chains.

When a desired object 28 of suitable size, shape, and color has been selected and a pin passed through its passage 30, the object is pushed along chain 12 until pin portion of retainer 14 passes through passage 30 and head 18 is in abutting relationship with the object 28.

Figure 3:
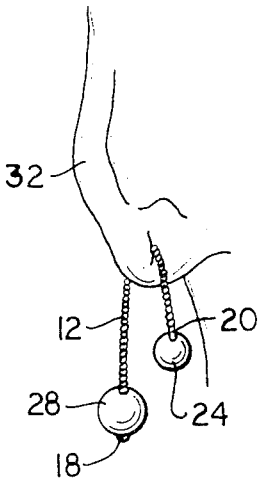
FIG. 3 is a perspective view showing the embodiment of the invention illustrated in FIG. 1 being worn by a user.

Pin 20 is then passed through an ear hole in the earlobe 32 of a user, as illustrated in FIG. 3. Pin 20 is then screwed into closure 24. The earring then may be worn as is illustrated in FIG. 3.

Figure 4:
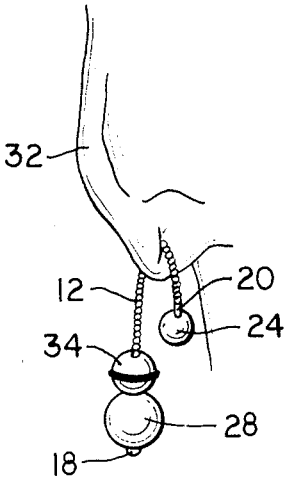
FIG. 4 is a perspective view of an alternative embodiment of the invention.
Figure 5:
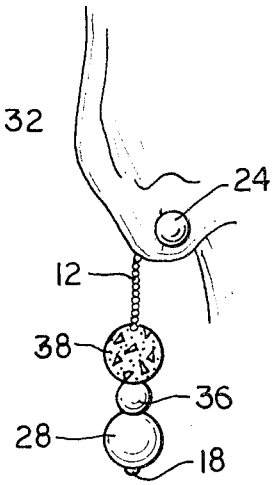
FIG. 5 is a perspective view of yet another inventive earring being worn in a manner different from that illustrated in FIGS. 3 and 4.

As discussed above, the size, shape, and color of the object 28 selected is chosen by the wearer. Such choice may be dictated by such factors as the clothing, makeup, hairdo, or the facial features of the wearer. If desired the wearer may also vary the number of objects supported by retainer 14. For example, a decorated bead 34 may be added, as is illustrated in FIG. 4, or a metallic bead 36 and a dark stone bead 38 as is illustrated in FIG. 5. It is also contemplated that the chain may be adjusted to achieve a desired visual effect. For example, the chain may be adjusted in such a manner that closure 24 is in abutting relationship with the ear 32 of the user, as is illustrated in FIG. 5.

Figure 6:
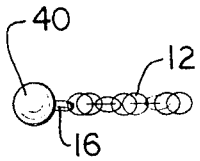
FIGS. 6, 7, and 8 are views of a part of alternative embodiments of earrings constructed in accordance with the present invention, showing various alternative retainer configurations.
Figure 7:
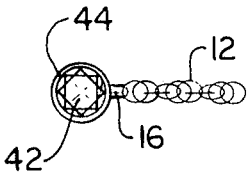
Figure 8:
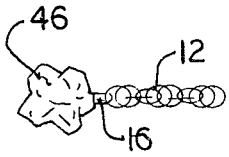

It is also contemplated that retainer 14 may be replaced by a gold ball 40, a cut jewel 42 in a bezel 44, or an object such as a gold nugget 46, as is illustrated in FIGS. 6, 7, and 8, respectively.

The inventive earring has a number of advantages over prior art earrings. As discussed above the wearer may select the color of the bead or other object to be suspended by the earring. He may also select the material from a wide range of materials such as precious or semi-precious stones and various metals or even synthetic materials such as lucite and other plastics. Likewise, the wearer may select the shape of the object to be suspended. Also, as discussed above, the chain may be slid to any desired position to create different visual effects.

The inventive earring is far more comfortable than conventional earrings for a number of reasons. These include its low weight, the flexibility of the chain and the fact that no pressure is being applied to the ear. The threaded connection between the pin 20 and closure 24 also makes for a more secure and more positive closure than conventional earrings. The overall expense of manufacturing is also lower because of a more efficient use of materials and a simplicity of design.

The use of a double-woven chain has a number of advantages. It is stronger than simple chains and the ear will not tend to close up around it. In the case of newly pierced ears, antiseptic may be applied to the earhole and will pass easily therethrough. This is not possible with a conventional post. Unlike a single-woven chain, which defines a passage which is substantially not filled with the metal of which the chain is made, a newly pierced ear will not heal closed around the individual wires of a double-woven chain.

While a number of illustrative embodiments of the invention have been described, it is, of course, understood that various modifications of the disclosed invention which do not depart from the spirit and scope of the invention will be obvious to those of ordinary skill in the art. Such modifications are within the scope of the invention which is limited and defined only by the appended claims.

I claim:

1. A method of hanging an ear ornament to maintain an unhealed earlobe hole opened and exposed to the air, comprising the steps of:

(a) passing a rigid securing member through a passage in a selectable decorative element;

(b) pulling a double-woven chain seured at one of its ends to one end of said rigid securing member through said passage;

(c) bringing a retainer member secured to the other end of said double-woven chain into abutting contact with said selectable decorative member;

(d) passing said rigid securing member completely through the earhole of a user so that said double-woven chain rests in said earhole;

(e) engaging said securing member with securing structure on a closure member.

2. A method as in claim 1, wherein said securing member is screwed into a threaded hole in said closure member.

3. A method as in claim 1, wherein said rigid securing member is inserted into said earhole until it extends from both sides of the earhole and is then pulled from the side opposite the chain to draw a portion of the chain through the earhole.

* * * * *